US012326280B2

(12) United States Patent
Kiya et al.

(10) Patent No.: US 12,326,280 B2
(45) Date of Patent: Jun. 10, 2025

(54) REFRIGERATION APPARATUS

(71) Applicant: Panasonic Intellectual Property Management Co., Ltd., Osaka (JP)

(72) Inventors: Toyoaki Kiya, Saitama (JP); Osamu Kosuda, Saitama (JP); Hiroshi Yatogo, Gunma (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 206 days.

(21) Appl. No.: 18/107,832

(22) Filed: Feb. 9, 2023

(65) Prior Publication Data

US 2023/0251004 A1 Aug. 10, 2023

(30) Foreign Application Priority Data

Feb. 10, 2022 (JP) ..... 2022-019606

(51) Int. Cl.
*F25B 7/00* (2006.01)
*F25B 31/00* (2006.01)

(52) U.S. Cl.
CPC ..... *F25B 31/004* (2013.01); *F25B 7/00* (2013.01)

(58) Field of Classification Search
CPC ..... F25B 7/00; F25B 31/002; F25B 31/004
See application file for complete search history.

(56) References Cited

U.S. PATENT DOCUMENTS 5,522,233 A * 6/1996 Nares ..... F25B 31/004 62/193

FOREIGN PATENT DOCUMENTS

| | | | |
|---|---|---|---|
| JP | 05-296583 | A | 11/1993 |
| JP | H11-173686 | A | 7/1999 |
| JP | 2001-124388 | A | 5/2001 |
| JP | 2010-127521 | A | 6/2010 |
| JP | 2017-138034 | A | 8/2017 |
| WO | 2013/073064 | A1 | 5/2013 |

* cited by examiner

*Primary Examiner* — Nael N Babaa
(74) *Attorney, Agent, or Firm* — Rimon P.C.

(57) ABSTRACT

Provided is a refrigeration apparatus capable of appropriately supplying oil separated by oil separators to compressors according to the situation. The refrigeration apparatus includes refrigeration units each including a compressor, an oil separator, an oil return pipe, and a heat dissipation heat exchanger; a pressure reducing valve connected to the heat dissipation heat exchangers; and an oil return control mechanism controlling a return destination of the oil separated by the oil separators. The oil return control mechanism includes an oil supply pipe connecting the oil return pipes; a flow control mechanism, controlling a flowing condition of oil in the oil supply pipe, disposed in the oil supply pipe; and an ejection control mechanism, controlling an ejection condition of oil ejected from the oil separator, disposed in each oil return pipe at a position closer to the oil separator than a connection position with the oil supply pipe is.

8 Claims, 5 Drawing Sheets

REFRIGERATION APPARATUS

TECHNICAL FIELD

This application is entitled to and claims the benefit of Japanese Patent Application No. 2022-019606 filed on Feb. 10, 2022, the disclosure of which including the specification, drawings and abstract is incorporated herein by reference in its entirety.

The present disclosure relates to a refrigeration apparatus.

BACKGROUND ART

Conventionally known is a configuration including a mechanism for separating oil from a refrigerant compressed by a compressor and a mechanism for returning the oil separated from the refrigerant to the compressor (see, for example, Patent Literature (hereinafter, referred to as PTL) 1).

The configuration of PTL 1 includes two compressors disposed in parallel and two oil separators disposed in parallel in a refrigeration cycle and one oil tank. Each compressor is connected to a corresponding one of the oil separators. Each compressor is connected to the oil tank via a first oil distribution pipe that includes a first electromagnetic valve disposed therein. Each oil separator is connected to the oil tank via a corresponding oil return pipe that includes a second electromagnetic valve disposed therein. The bottom of the oil tank is connected to each compressor via a second oil distribution pipe.

During the operation of the refrigeration apparatus, an operation of closing the first electromagnetic valve and opening the second electromagnetic valve (hereinafter referred to as "first operation"), and an operation of opening the first electromagnetic valve and closing the second electromagnetic valve (hereinafter referred to as "second operation") are repeated at predetermined time intervals. When the first operation is performed, the oil separated by each oil separator is returned to the oil tank, and then supplied from the oil tank to each oil separator as the internal pressure of the oil tank rises due to the internal pressure of the oil separators. On the other hand, when the second operation is performed, the internal pressure of the oil tank and the internal pressure of each compressor become equal. Therefore, when the oil levels in the compressors are higher than the oil drain, the oil in the compressors flows to the oil tank through the oil drain. The repetition of the first operation and the second operation allows adjusting of the position of the oil level in each compressor to a predetermined position.

CITATION LIST

Patent Literature

PTL 1

Japanese Patent Application Laid-Open No. H11-173686

SUMMARY OF INVENTION

Technical Problem

In a configuration as described in PTL 1, when the pressure between one compressor and one oil separator differs from the pressure between the other compressor and the other oil separator, the amounts of the oil separated by the oil separators may differ. In such a case, the amount of the oil separated by one of the oil separators becomes almost zero. Even in such a case, the first operation of returning oil from this one oil separator to the oil tank is needlessly performed in the configuration as of PTL 1.

An object of the present disclosure is to provide a refrigeration apparatus capable of appropriately supplying oil separated by oil separators to compressors according to the situation.

Solution to Problem

A refrigeration apparatus of the present disclosure includes: a plurality of refrigeration units each including a compressor, an oil separator, an oil return pipe that returns oil separated from a refrigerant by the oil separator to the compressor, and a heat dissipation heat exchanger that cools the refrigerant from which the oil has been separated; a pressure reducing valve connected to the heat dissipation heat exchangers of the plurality of refrigeration units; and an oil return control mechanism that controls a return destination of the oil separated by at least one of the oil separators of the plurality of refrigeration units. In the refrigeration apparatus, the oil return control mechanism includes an oil supply pipe that connects the oil return pipes of the plurality of refrigeration units to each other, a flow control mechanism disposed in the oil supply pipe, the flow control mechanism controlling a flowing condition of oil in the oil supply pipe, and ejection control mechanisms each disposed in a corresponding one of the oil return pipes at a position closer to a corresponding one of the oil separators than a connection position is, each of the ejection control mechanisms controlling an ejection condition of oil ejected from the corresponding oil separator, the connection position being a position where the corresponding oil return pipe connects to the oil supply pipe.

Advantageous Effects of Invention

A refrigeration apparatus of the present disclosure is capable of appropriately supplying oil separated by oil separators to compressors according to the situation.

DESCRIPTION OF EMBODIMENTS

Embodiments

Hereinafter, the embodiments of the present disclosure will be described.

Configuration of Refrigeration Apparatus

Figure 1:
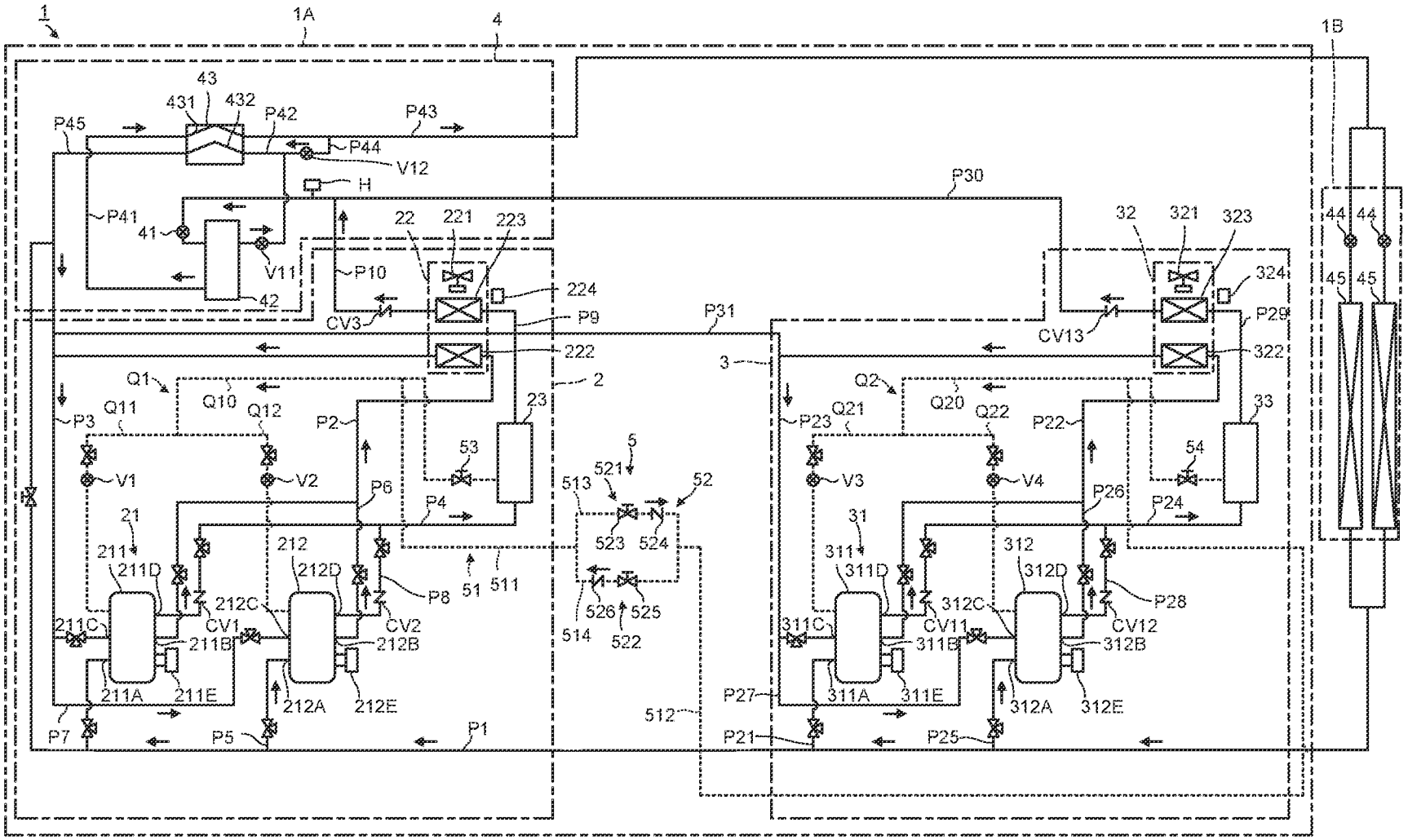
FIG. 1 is a block diagram illustrating a schematic configuration of a refrigeration apparatus.
Figure 2:
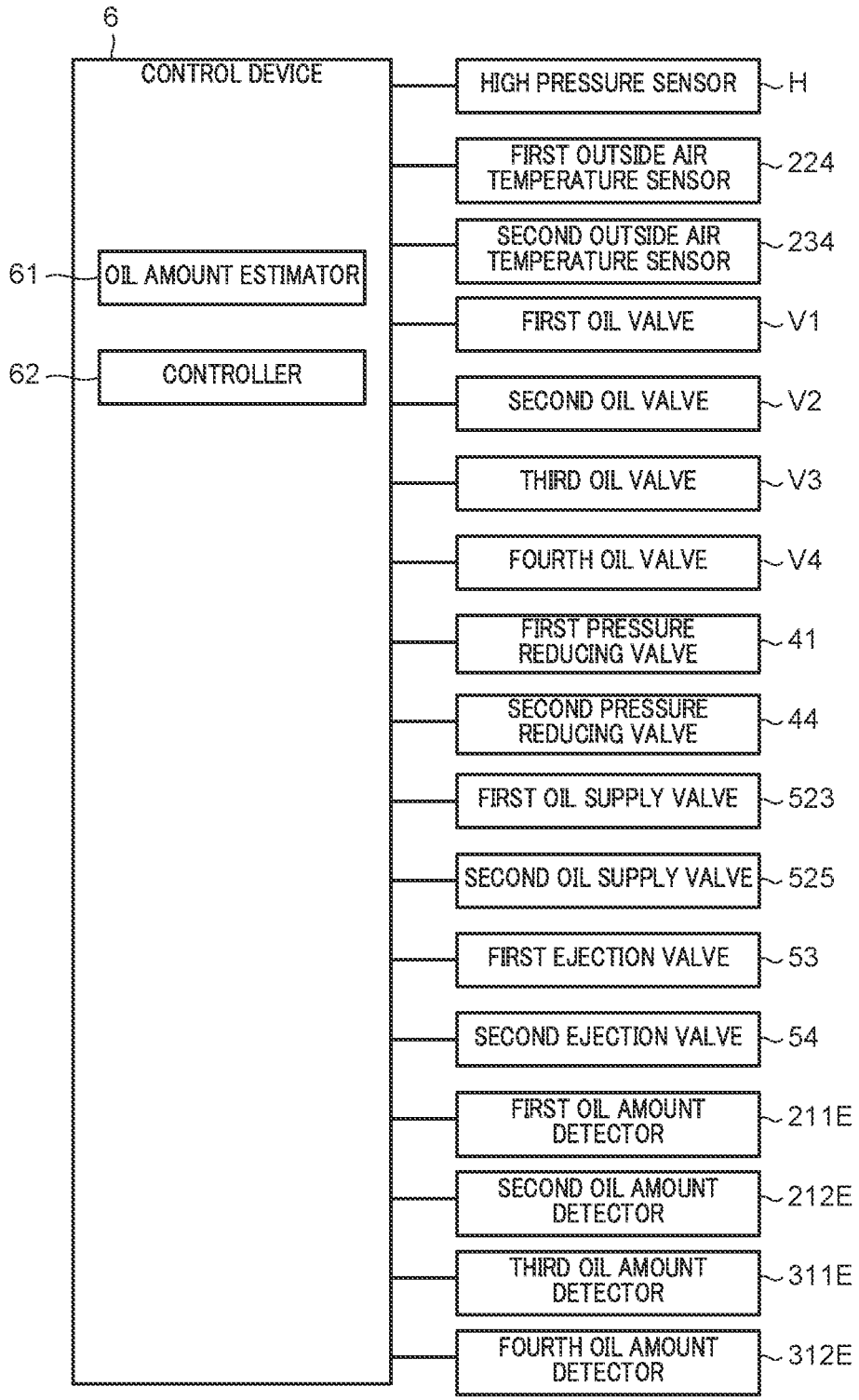
FIG. 2 is a block diagram illustrating a control system of the refrigeration apparatus.
Figure 3:
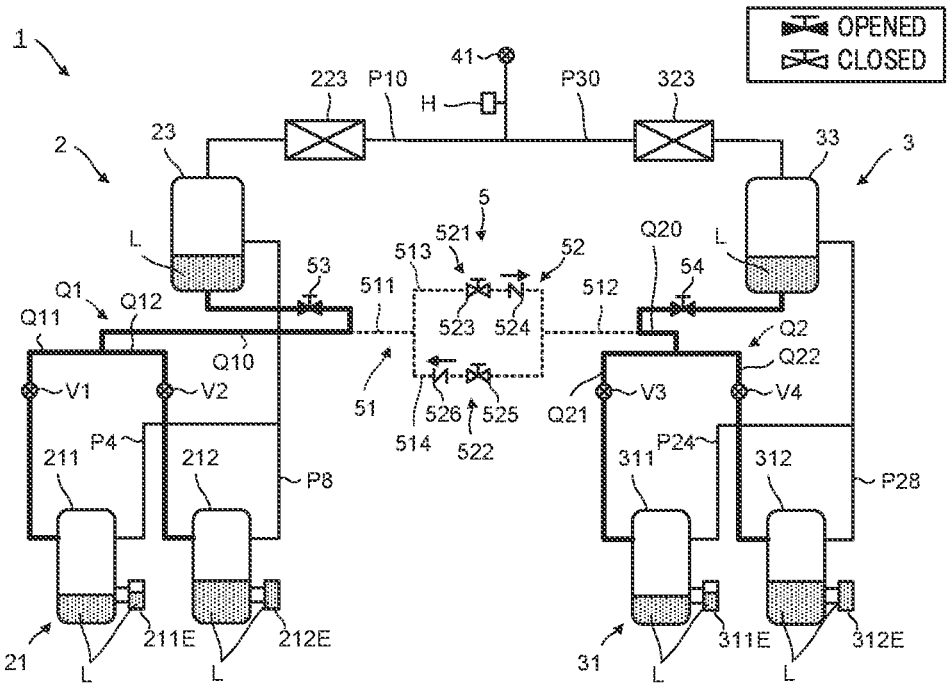
FIG. 3 is an explanatory diagram of first control.
Figure 4:
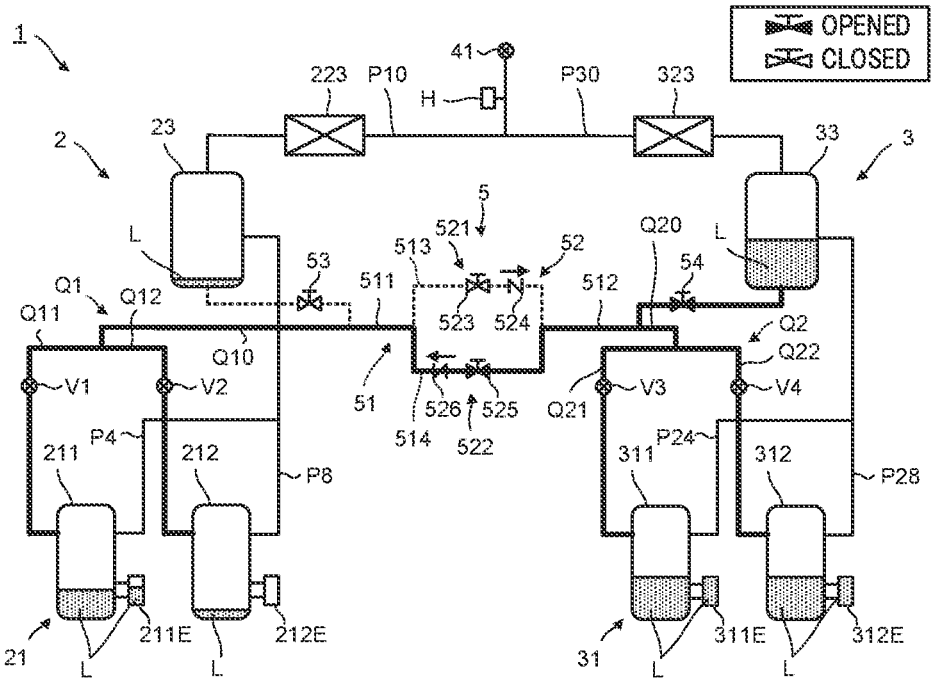
FIG. 4 is an explanatory diagram of first oil supply control.
Figure 5:
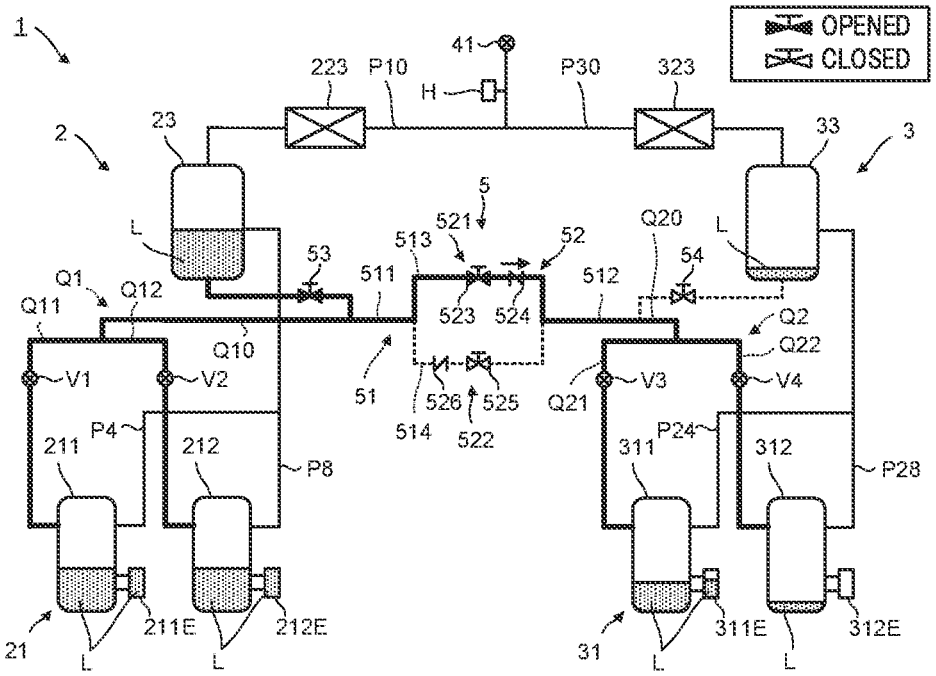
FIG. 5 is an explanatory diagram of second oil supply control.

In the following, the configuration of a refrigeration apparatus will be described. FIG. 1 is a block diagram illustrating a schematic configuration of a refrigeration apparatus. FIG. 2 is a block diagram illustrating a control system of the refrigeration apparatus. FIG. 3 is an explanatory diagram of first control. FIG. 4 is an explanatory diagram of first oil supply control. FIG. 5 is an explanatory diagram of second oil supply control.

Refrigeration apparatus 1 illustrated in FIG. 1 includes refrigerator 1A and cooling unit 1B.

Refrigerator 1A includes first refrigeration unit 2, second refrigeration unit 3, subcooling mechanism 4, and oil return control mechanism 5. First refrigeration unit 2 and second refrigeration unit 3 are disposed in parallel in a refrigeration cycle. First refrigeration unit 2 and second refrigeration unit 3 have substantially the same configuration; thus first refrigeration unit 2 will be described in detail, and second refrigeration unit 3 will be described briefly.

First refrigeration unit 2 includes first compression section 21, first heat exchanger for heat dissipation (herein also referred to as "heat dissipation heat exchanger") 22, and first oil separator 23.

First compression section 21 includes first compressor 211 and second compressor 212. First compressor 211 and second compressor 212 are disposed in parallel in a refrigeration cycle. First compression section 21 may include one compressor or three or more compressors. When first compression section 21 includes three or more compressors, the three or more compressors are disposed in parallel in the refrigeration cycle. First compressor 211 and second compressor 212 have substantially the same configuration; thus first compressor 211 will be described in detail, and second compressor 212 will be described briefly.

First compressor 211 includes an hermetic container. At the hermetic container, first low-stage suction port 211A, first low-stage discharge port 211B, first high-stage suction port 211C, and first high-stage discharge port 211D are formed. A pair of evaporators 45 of cooling unit 1B are connected to first low-stage suction port 211A via pipe P1. First intercooler 222 of first heat dissipation heat exchanger 22 is connected to first low-stage discharge port 211B via pipe P2. First intercooler 222 is connected to first high-stage discharge port 211C via pipe P3. First oil separator 23 is connected to first high-stage discharge port 211D via pipe P4. Check valve CV1 is disposed in pipe P4 to prevent a refrigerant discharged from first high-stage discharge port 211D from flowing back to first high-stage discharge port 211D.

A first low-stage compression element, a first high-stage compression element, and a first motor (all not illustrated) are disposed in the hermetic container of first compressor 211. The first low-stage compression element and the first high-stage compression element rotate in synchronization with the rotation of the first motor.

When the first motor rotates, the first low-stage compression element increases the pressure of a low-pressure refrigerant, sucked from the pair of evaporators 45 via pipe P1 and first low-stage suction port 211A, to intermediate pressure. The first low-stage compression element discharges the refrigerant pressurized to have the intermediate pressure to first intercooler 222 via first low-stage discharge port 211B and pipe P2. The first high-stage compression element increases the intermediate pressure of the refrigerant, sucked from first intercooler 222 via first high-stage suction port 211C and pipe P3, to high pressure. The first high stage compression element discharges the refrigerant pressurized to have the high pressure to first oil separator 23 via first high-stage discharge port 211D and pipe P4. As described above, first compressor 211 compresses a refrigerant in two stages.

Second compressor 212 includes an hermetic container at which second low-stage suction port 212A, second low-stage discharge port 212B, second high-stage suction port 212C, and second high-stage discharge port 212D are formed. The pair of evaporators 45 are connected to second low-stage suction port 212A via pipe P5 branched from pipe P1. First intercooler 222 is connected to second low-stage discharge port 212B via pipe P6 branched from pipe P2. First intercooler 222 is connected to second high-stage suction port 212C via pipe P7 branched from pipe P3. First oil separator 23 is connected to second high-stage discharge port 212D via pipe P8 branched from pipe P4. Check valve CV2 is disposed in pipe P8.

A second low-stage compression element, a second high-stage compression element, and a second motor (all not illustrated) are disposed in the hermetic container of second compressor 212. In a manner similar to first compressor 211, second compressor 212 compresses a refrigerant in two stages by rotating the second low-stage compression element and the second high-stage compression element in synchronization with the rotation of the second motor.

At the hermetic container of first compressor 211, first oil amount detector 211E for detecting the remaining amount of oil in the hermetic container is disposed. At the hermetic container of second compressor 212, second oil amount detector 212E for detecting the remaining amount of oil is disposed. First and second oil amount detectors 211E and 212E are configured from, for example, oil level switches, and the detectors output signals corresponding to the detected remaining amounts to control device 6 illustrated in FIG. 2.

First heat dissipation heat exchanger 22 includes first heat dissipation fan 221, first intercooler 222, and first gas cooler 223.

First heat dissipation fan 221 cools first intercooler 222 and first gas cooler 223.

First intercooler 222 cools refrigerants with intermediate pressure discharged from first and second low-stage compression elements of first and second compressors 211 and 212, and discharges the refrigerants to the first and second high-stage compression elements.

First gas cooler 223 is connected to first oil separator 23 via pipe P9. First gas cooler 223 is connected to intermediate cooler 42 of subcooling mechanism 4 via pipe P10. First gas cooler 223 cools a high-pressure refrigerant discharged from first oil separator 23 and discharges the refrigerant to intermediate cooler 42. Check valve CV3 is disposed in pipe P10 to prevent a refrigerant discharged from first gas cooler 223 from flowing back to first gas cooler 223.

First outside air temperature sensor 224 is disposed in the vicinity of first heat dissipation heat exchanger 22. First outside air temperature sensor 224 outputs a signal corresponding to the detection result of an outside air temperature to control device 6.

First oil separator 23 is connected to the hermetic containers of first compressor 211 and second compressor 212 via first oil return pipe Q1. First oil return pipe Q1 includes first base pipe Q10, first branch pipe Q11, and second branch pipe Q12. One end of first base pipe Q10 is connected to first oil separator 23. First branch pipe Q11 connects the other end of first base pipe Q10 with the hermetic container of first compressor 211. Second branch pipe Q12 connects the other end of first base pipe Q10 with the hermetic container of second compressor 212. First oil separator 23 separates oil contained in high-pressure refrigerants discharged from the first and second high-stage compression elements of first and second compressors 211 and 212 and stores the oil. First oil separator 23 returns the stored oil to first and second compressors 211 and 212 via first oil return pipe Q1.

First oil valve V1 is disposed in first branch pipe Q11. Second oil valve V2 is disposed in second branch pipe Q12. First oil valve V1 and second oil valve V2 are each configured from, for example, an electric valve, and opened and closed under the control of control device 6. The return destination of the oil from first oil separator 23 is controlled by adjusting the opening degrees of first oil valve V1 and second oil valve V2.

Second refrigeration unit 3 includes second compression section 31, second heat dissipation heat exchanger 32, and second oil separator 33.

Second compression section 31 includes third compressor 311 and fourth compressor 312.

The pair of evaporators 45 are connected to third low-stage suction port 311A of third compressor 311 via pipe P21 branched from pipe P1. Second intercooler 322 of second heat dissipation heat exchanger 32 is connected to third low-stage discharge port 311B of third compressor 311 via pipe P22. Second intercooler 322 is connected to third high-stage suction port 311C of third compressor 311 via pipe P23. Pipe P31 connected to pipe P3 is connected to pipe P23. Second oil separator 33 is connected to third high-stage discharge port 311D of third compressor 311 via pipe P24. Check valve CV11 is disposed in pipe P24.

A third low-stage compression element, a third high-stage compression element, and a third motor (all not illustrated) are disposed in the hermetic container of third compressor 311. In a manner similar to first compressor 211, third compressor 311 compresses a refrigerant in two stages by rotating the third low-stage compression element and the third high-stage compression element in synchronization with the rotation of the third motor.

The pair of evaporators 45 are connected to fourth low-stage suction port 312A of fourth compressor 312 via pipe P25 branched from pipe P1. Second intercooler 322 is connected to fourth low-stage discharge port 312B of fourth compressor 312 via pipe P26 branched from pipe P22. Second intercooler 322 is connected to fourth high-stage suction port 312C of fourth compressor 312 via pipe P27 branched from pipe P23. Second oil separator 33 is connected to fourth high-stage discharge port 312D of fourth compressor 312 via pipe P28 branched from pipe P24. Check valve CV12 is disposed in pipe P28.

A fourth low-stage compression element, a fourth high-stage compression element, and a fourth motor (all not illustrated) are disposed in the hermetic container of fourth compressor 312. In a manner similar to third compressor 311, fourth compressor 312 compresses a refrigerant in two stages by rotating the fourth low-stage compression element and the fourth high-stage compression element in synchronization with the rotation of the fourth motor.

Third oil amount detector 311E is disposed at the hermetic container of third compressor 311. Fourth oil amount detector 312E is disposed at the hermetic container of fourth compressor 312. Third and fourth oil amount detectors 311E and 312E are configured from, for example, oil level switches, and the detectors output signals corresponding to the remaining amounts of oil in the hermetic containers of third and fourth compressors 311 and 312 to control device 6.

Second heat dissipation heat exchanger 32 includes second heat dissipation fan 321, second intercooler 322, and second gas cooler 323. Second gas cooler 323 is connected to second oil separator 33 via pipe P29. Second gas cooler 323 is connected to intermediate cooler 42 via pipe P30 branched from pipe P10. Check valve CV13 is disposed in pipe P30. Second outside air temperature sensor 324 is disposed in the vicinity of second heat dissipation heat exchanger 32. Second outside air temperature sensor 324 outputs a signal corresponding to the detection result of an outside air temperature to control device 6.

Second oil separator 33 is connected to the hermetic containers of third compressor 311 and fourth compressor 312 via second oil return pipe Q2 including second base pipe Q20, third branch pipe Q21, and fourth branch pipe Q22. Second oil separator 33 separates oil contained in high-pressure refrigerants discharged from third and fourth compressors 311 and 312 and returns the separated oil to third and fourth compressors 311 and 312. Third oil valve V3 and fourth oil valve V4 that are opened and closed under the control of control device 6 are disposed in third branch pipe Q21 and fourth branch pipe Q22, respectively. Third oil valve V3 and fourth oil valve V4 are each configured from, for example, an electric valve.

High pressure sensor H is disposed in pipe 10 at a position closer to intermediate cooler 42 than a connection position, where pipe P10 connects to pipe P30, is. High pressure sensor H outputs a signal corresponding to the pressure of pipe P10 to control device 6. The pressure detected by high pressure sensor H is approximately the same as the pressure inside first and second gas coolers 223 and 323 and first and second oil separators 23 and 33.

Subcooling mechanism 4 includes first pressure reducing valve 41, intermediate cooler 42, and split heat exchanger 43.

First pressure reducing valve 41 is configured from, for example, an electric valve. First pressure reducing valve 41 is disposed in pipe 10 at a position closer to intermediate cooler 42 than the connection position, where pipe P10 connects to pipe P30, is. First pressure reducing valve 41 reduces the pressure of high-pressure refrigerants discharged from first gas cooler 223 and second gas cooler 323, and discharges the refrigerants into the upper portion of intermediate cooler 42.

The lower portion of intermediate cooler 42 is connected to one end of first flow channel 431 of split heat exchanger 43 via pipe P41. The upper portion of intermediate cooler 42 is connected to one end of second flow channel 432 of split heat exchanger 43 via pipe P42. Gas return electric valve (namely, electric valve for returning gas) V11 is disposed in pipe P42. Intermediate cooler 42 cools the refrigerant decompressed by first pressure reducing valve 41. The refrigerant (liquid refrigerant) liquefied by the cooling is discharged to first flow channel 431 of split heat exchanger 43 via pipe P41. The refrigerant (gas refrigerant) that has not been liquefied by the cooling is discharged to second flow channel 432 of split heat exchanger 43 via pipe P42.

The other end of first flow channel 431 of split heat exchanger 43 is connected to the pair of evaporators 45 via pipe P43. Pipe P44 branched from pipe P42 is connected to pipe P43 at a position between the ends of pipe P43. Liquid return electric valve (namely, electric valve for returning liquid) V12 is disposed in pipe P44. The other end of second flow channel 432 of split heat exchanger 43 is connected to pipe P3 via pipe P45.

In split heat exchanger 43 having such a configuration, when liquid return electric valve V12 is open, the following occurs: while the majority of the liquid refrigerant discharged from intermediate cooler 42 flows into evaporator 45 through first flow channel 431 and pipe P43, the rest of the liquid refrigerant passes through pipes P44 and P42 and flows into second flow channel 432. As the rest of the liquid refrigerant flows into second flow channel 432, the refrigerant passing through first flow channel 431 toward evaporators is supercooled. The gas refrigerant discharged from intermediate cooler 42 passes through pipe P42, second flow channel 432, and pipes P45, P3, P7, P31, P23, and P27, and returns to the first, second, third, and fourth high-stage compression elements of first, second, third, and fourth compressors 211, 212, 311, and 312.

Cooling unit 1B is disposed, for example, in a showcase. Cooling unit 1B includes a pair of second pressure reducing valves 44 and the pair of evaporators 45.

Pipe P43 is branched into two at a position located closer to evaporators 45 than the connecting portion, where pipe P43 connects with pipe P44, is. Second pressure reducing valve 44 is disposed at each of the two branched portions. In addition, evaporator 45 is connected to the distal end of each of the two branched portions. Pipe P1 is branched into two at a position located closer to evaporators 45 than the connecting portion, where pipe 1 connects with pipe P25, is. Evaporator 45 is connected to the distal end of each of the two branched portions.

Each second pressure reducing valve 44 is configured from, for example, an electric valve. Each second pressure reducing valve 44 reduces the pressure of the refrigerant discharged from split heat exchanger 43 and discharges the refrigerant to each evaporator 45.

Each evaporator 45 generates cooling air for cooling an object to be cooled by exchanging heat between a liquid refrigerant flowing from corresponding second pressure reducing valve 44 and air around evaporator 45. After the heat exchange, the refrigerant passes through pipes P1, P5, P21, and P25, and returns to the first, second, third, and fourth low-stage compression elements of first, second, third, and fourth compressors 211, 212, 311, and 312.

Oil return control mechanism 5 controls the return destination of the oil separated by first and second oil separators 23 and 33 of first and second refrigeration units 2 and 3.

Oil return control mechanism 5 includes oil supply pipe 51, flow control mechanism 52, first ejection valve 53, and second ejection valve 54. First ejection valve 53 and second ejection valve 54 are exemplary ejection control mechanisms.

Oil supply pipe 51 connects first base pipe Q10 of first oil return pipe Q1, connected to first oil separator 23, with second base pipe Q20 of second oil return pipe Q2, connected to second oil separator 33. Oil supply pipe 51 includes first base pipe for supplying oil (herein also referred to as "oil supply base pipe") 511, second oil supply base pipe 512, first branch pipe for supplying oil (herein also referred to as "oil supply branch pipe") 513, and second oil supply branch pipe 514. One end of first oil supply base pipe 511 is connected to first base pipe Q10 of first oil return pipe Q1. One end of first oil supply branch pipe 513 and one end of second oil supply branch pipe 514 are connected to the other end of first oil supply base pipe 511. One end of second oil supply base pipe 512 is connected to second base pipe Q20 of second oil return pipe Q2. The other end of first oil supply branch pipe 513 and the other end of second oil supply branch pipe 514 are connected to the other end of second supply base pipe 512.

Control mechanism 52 is disposed in the oil supply pipe 51 and controls the flowing condition of oil in oil supply pipe 51. Flow control mechanism 52 includes first regulating mechanism 521 and second regulating mechanism 522 disposed in parallel in oil supply pipe 51.

First regulating mechanism 521 is disposed in first oil supply branch pipe 513. First regulating mechanism 521 includes first oil supply valve 523 and first check valve for oil supply (herein also referred to as "oil supply check valve") 524 disposed in series. Second regulating mechanism 522 is disposed in second oil supply branch pipe 514. Second regulating mechanism 522 includes second oil supply valve 525 and second oil supply check valve 526 disposed in series. First oil supply valve 523 and second oil supply valve 525 are each configured from, for example, an electromagnetic valve, and opened and closed under the control of control device 6. First oil supply check valve 524 is disposed at a position closer to second refrigeration unit 3 than first oil supply valve 523 is. First oil supply check valve 524 is configured to prevent oil, flowing from first oil supply valve 523 toward second refrigeration unit 3, from flowing back to first oil supply valve 523. Second oil supply check valve 526 is disposed at a position closer to first refrigeration unit 2 than second oil supply valve 525 is. Second oil supply check valve 526 is configured to prevent oil, flowing from second oil supply valve 525 toward first refrigerating unit 2, from flowing back to second oil supply valve 525. In other words, first oil supply check valve 524 and second oil supply check valve 526 are disposed in such a way that the valves allow oil to flow only in respective directions different from each other.

First ejection valve 53 is disposed in first base pipe Q10 at a position closer to first oil separator 23 than the connection position, where first base pipe Q10 connects to oil supply pipe 51, is. First ejection valve 53 controls the ejection condition of oil ejected from first oil separator 23. Second ejection valve 54 is disposed in second base pipe Q20 at a position closer to second oil separator 33 than the connection position, where second base pipe Q20 connects to oil supply pipe 51, is. Second ejection valve 54 controls the ejection condition of oil ejected from second oil separator 33. First ejection valve 53 and second ejection valve 54 are each configured from, for example, an electromagnetic valve, and opened and closed under the control of control device 6.

Control device 6 illustrated in FIG. 2 controls the operation of the entire refrigeration apparatus 1. Control device 6 is configured in such a way that signals can be sent and received between high pressure sensor H, first and second outside air temperature sensors 224 and 324, first to fourth oil valves V1 to V4, first and second pressure reducing valves 41 and 44, first and second oil supply valves 523 and 525, first and second ejection valves 53 and 54, and first, second, third, and fourth oil amount detectors 211E, 212E, 311E, and 312E. Control device 6 includes oil amount estimator 61 and controller 62.

Oil amount estimator 61 determines whether or not the oil amounts in first and second oil separators 23 and 33 are less than a first threshold based on the detection results of first, second, third, and fourth oil amount detectors 211E, 212E, 311E, and 312E. In the above configuration, the oil amounts in first and second oil separators 23 and 33 are estimated by using oil amount detectors, which are typically disposed in the compressors. Therefore, the provision of a new configuration for detecting the oil amounts in first and second oil separators 23 and 33 in refrigeration apparatus 1 becomes unnecessary.

Controller 62 performs the following control: first control to independently circulate oil in first refrigeration unit 2 and oil in second refrigeration unit 3 by controlling oil return control mechanism 5, as illustrated in FIG. 3; and second control to supply, into a predetermined refrigeration unit, oil in other refrigeration unit. The second control includes the following: first oil supply control to supply oil separated by second oil separator 33 of second refrigeration unit 3 to second compression section 31 of second refrigeration unit 3 and to first compression section 21 of first refrigeration unit 2, as illustrated in FIG. 4; and second oil supply control to supply oil separated by first oil separator 23 of first refrigeration unit 2 to first compression section 21 and second compression section 31, as illustrated in FIG. 5. Controller 62 performs the first control when oil amount estimator 61 estimates that the oil amounts in first and second oil separators 23 and 33 are equal to or greater than the first threshold. On the other hand, controller 62 performs the first oil supply control when oil amount estimator 61 estimates that the oil amount in first oil separator 23 is less than the first threshold. In addition, controller 62 performs the second oil supply control when oil amount estimator 61 estimates that the oil amount in second oil separator 33 is less than the first threshold.

In the following, the reason for performing the second control will be described. When the first control is performed by driving first and second compression sections 21 and 31, refrigerants containing oil (hereinafter may be referred to as "oil-containing refrigerants") pass through first and second oil separators 23 and 33 and return to first and second compression sections 21 and 31 via first and second gas coolers 223 and 323, first and second pressure reducing valves 41 and 44, and evaporators 45 in some cases. In such cases, when the amounts of the oil-containing refrigerants returning to first and second compression sections 21 and 31 are substantially the same, the amounts of oil circulating in first and second refrigeration units 2 and 3 in the first control become substantially the same. The amounts of oil separated by first and second oil separators 23 and 33 thus become substantially the same. As a result, both of the oil amounts in first and second oil separators 23 and 33 are equal to or greater than the first threshold. The first threshold is set to a value such that the oil amounts in first, second, third, and fourth compressors 211, 212, 311, and 312 are adjusted to be equal to or greater than the second threshold by returning oil stored in first oil separator 23 to first and second compressors 211 and 212, or returning oil stored in second oil separator 33 to third and fourth compressors 311 and 312.

However, for example, the amounts of oil circulating in first and second refrigeration units 2 and 3 in the first control differ to each other in the following cases.

(1) When the amounts of oil-containing refrigerants returning from evaporators 45 to first, second, third, and fourth compressors 211, 212, 311, and 312 differ from each other depending on how the oil-containing refrigerants are divided during the returning.

(2) When the speed, at which the oil is removed from a separator, varies between first and second oil separators 23 and 33 because the speed of oil returning from first oil separator 23 to first compression section 21 differs from the speed of oil returning from second oil separator 33 to second compression section 31—this difference in the oil speed is caused by the difference between the intermediate pressure and the high pressure in a refrigeration unit varies between first and second refrigeration units 2 and 3

(3) When the operating frequencies of first and second compressors 211 and 212 forming first compression section 21 differ from the operating frequencies of third and fourth compressors 311 and 312 forming second compression section 31.

In such cases, for example, the amount of oil in first oil separator 23 becomes less than the first threshold, and the amount of oil in at least one of first and second compressors 211 and 212 cannot be adjusted to be equal to or greater than the second threshold. The second control is performed to prevent the occurrence of such problems.

Specific processing performed by oil amount estimator 61 and controller 62 will be described below.

Figure 6:
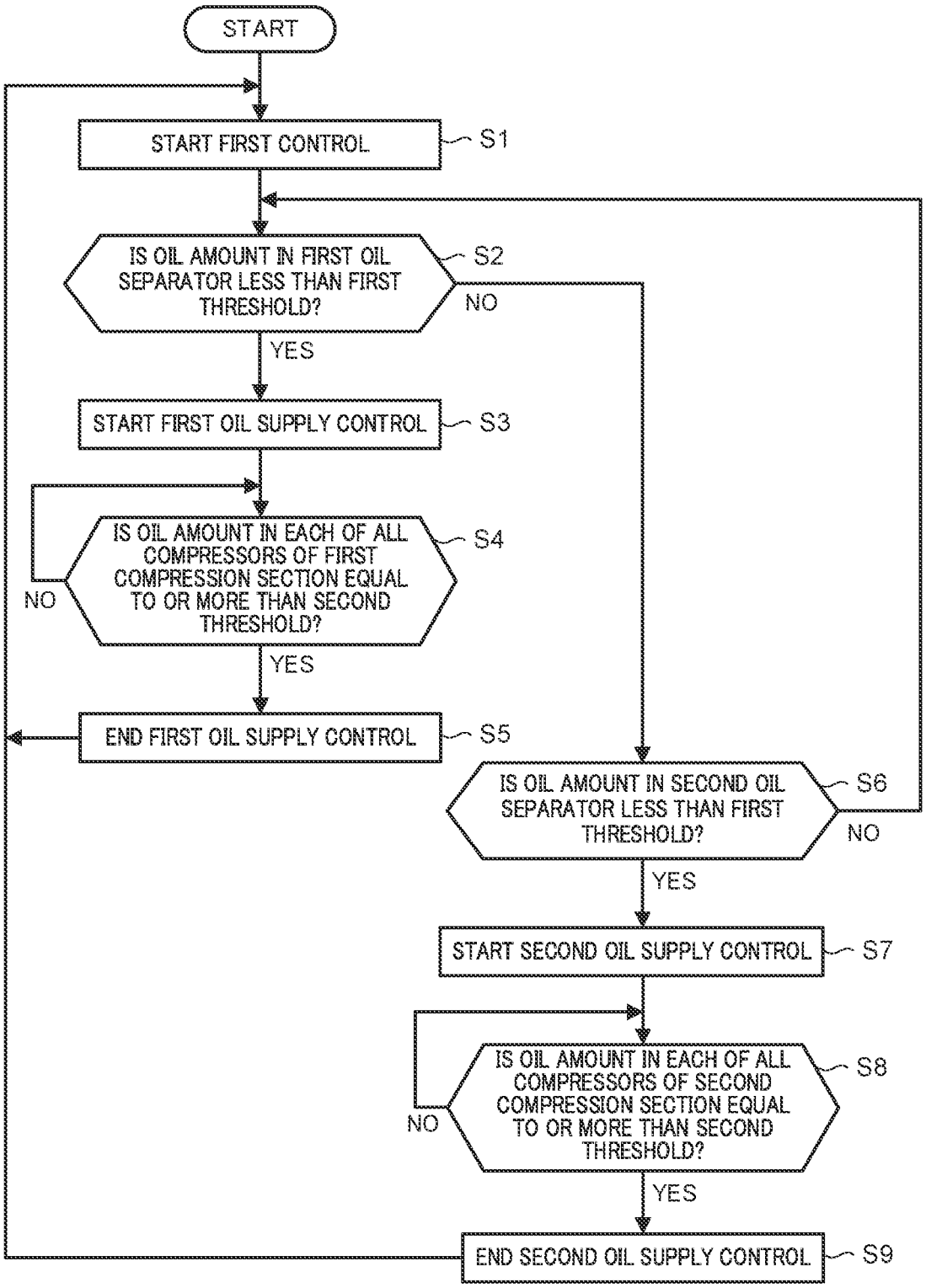
FIG. 6 is a flowchart illustrating the operation of the refrigeration apparatus.

In the following, the operation of refrigeration apparatus 1 will be described with reference to FIGS. 3 to 6. An exemplary operation of cooling an object to be cooled by using refrigerants that have been two-stage compressed by first, second, third, and fourth compressors 211, 212, 311, and 312 will be described. In a case where an object to be cooled is cooled by using refrigerants that have been two-stage compressed by at least one compressor forming first compression section 21 and at least one compressor forming second compression section 31, an operation similar to the operation described below is performed. In FIGS. 3 to 5, when a symbol showing corresponding one of first and second ejection valves 53 and 54 and first and second oil supply valves 523 and 525 is black, the symbol represents the opened state of valve 53, 54, 523, or 525, and when the symbol is white, the symbol represents the closed state of valve 53, 54, 523, or 525. FIG. 6 is a flowchart illustrating the operation of the refrigeration apparatus.

When a user operates the operation section (not illustrated) to issue a command to start the operation of refrigeration apparatus 1, controller 62 starts the first control (step S1). At the start of the first control, controller 62 opens first and second ejection valves 53 and 54 of oil return control mechanism 5 and also closes first and second oil supply valves 523 and 525, as illustrated in FIG. 3. Controller 62 then starts the operation of first and second compression sections 21 and 31. When the operation of first and second compression sections 21 and 31 is started, a refrigerant that has been two-stage compressed by first compression section 21 flows into first oil separator 23 and a refrigerant that has been two-stage compressed by second compression section 31 flows into second oil separator 33.

Oil separated from the refrigerant by first oil separator 23 is stored in first oil separator 23. Oil separated from the refrigerant by second oil separator 33 is stored in second oil separator 33. Based on the detection results of first and second oil amount detectors 211E and 212E, controller 62 supplies oil L in the first oil separator 23 to first and second compressors 211 and 212 in such a way that the amounts of oil L in first compressor 211 and oil L in second compressor 212 are adjusted to be equal to or greater than the second threshold. For example, controller 62 keeps first oil valve V1 open until the amount of oil L in first compressor 211 becomes equal to or greater than the second threshold. Controller 62 reduces the opening degree of first oil valve V1 when the amount of oil L becomes equal to or greater than the second threshold. At this time, the pressure in first oil separator 23 is higher than the pressure in the portion into which oil L flows in first compressor 211. Due to the pressure difference, oil L in first oil separator 23 is supplied into first compressor 211. In addition, based on the detection results of third and fourth oil amount detectors 311E and 312E, controller 62 supplies oil L in second oil separator 33 to third and fourth compressors 311 and 312 in such a way that the amounts of oil L in third compressor 311 and oil L in fourth compressor 312 are adjusted to be equal to or greater than the second threshold.

The refrigerants that have passed through first and second oil separators 23 and 33 are decompressed by first and second pressure reducing valves 41 and 44 and used to generate cooling air in evaporators 45.

During the first control, first oil supply control, and second oil supply control, controller 62 controls first pressure reducing valve 41 based on the detection results regarding an outside air temperature from first and second outside air temperature sensors 224 and 324 in such a way that the pressure in first and second oil separators 23 and 33 is adjusted to be a target high pressure value based on the outside air temperature. Specifically, controller 62 controls first pressure reducing valve 41 in such a way that the higher the outside air temperature, the higher the pressure detected by high pressure sensor H.

Oil amount estimator 61 then estimates whether or not the amount of oil L in first oil separator 23 is less than the first threshold (step S2). For example, when the amount of oil L in at least one of first compressor 211 and second compressor 212 is less than the second threshold for a predetermined time or longer, oil amount estimator 61 estimates that the amount of oil L in first oil separator 23 is less than the first threshold.

For example, when the amount of oil L in first oil separator 23 is estimated to be less than the first threshold because the amount of oil L in second compressor 212 is less than the second threshold (step S2: YES) as illustrated in FIG. 4, controller 62 starts the first oil supply control (step S3). Controller 62 closes first ejection valve 53 and also opens second oil supply valve 525 of second regulating mechanism 522 at the start of the first control. Such control prevents oil L in first oil separator 23 from being ejected. Such control also maintains the state in which oil L in second oil separator 33 is supplied to third and fourth compressors 311 and 312. Further, the pressure in second oil separator 33 is higher than the pressure in the portion into which oil L flows in first compression section 21. Oil L in second oil separator 33 is thus supplied via second regulating mechanism 522 to one of first compressor 211 and second compressor 212, that is, to the compressor in which the amount of oil L is less than the second threshold.

Based on the detection results of first and second oil amount detectors 211E and 212E, controller 62 determines whether or not the amount of oil L in each of all the compressors (first and second compressors 211 and 212) of first compression section 21 has reached or exceeded the second threshold (step S4). When controller 62 determines that the amount of oil L has not reached or exceeded the second threshold in all the compressors of first compression section 21 (step S4: NO), controller 62 performs the process of step S4 after a predetermined period of time. When controller 62 determines that the amount of oil L in each of all the compressors of first compression section 21 has reached or exceeded the second threshold (step S4: YES), controller 62 closes second oil supply valve 525 of second regulating mechanism 522 and also opens first ejection valve 53, thereby ending the first oil supply control (step S5), and starting first control. (Step S1).

On the other hand, when oil amount estimator 61 estimates that the amount of oil L in first oil separator 23 is not less than the first threshold (step S2: NO), oil amount estimator 61 estimates whether or not the amount of oil L in second oil separator 33 is less than the first threshold by using substantially the same method as the process of step S2 (step S6). When oil amount estimator 61 estimates that the amount of oil L in second oil separator 33 is not less than the first threshold (step S6: NO), after a predetermined period of time, for example, oil amount estimator 61 estimates whether or not the amount of oil L in first oil separator 23 is less than the first threshold (step S2).

On the other hand, for example, when the amount of oil L in second oil separator 33 is estimated to be less than the first threshold because the amount of oil L in fourth compressor 312 is less than the second threshold (step S6: YES) as illustrated in FIG. 5, controller 62 starts the second oil supply control (step S7). Controller 62 closes second ejection valve 54 and also opens first oil supply valve 523 of first regulating mechanism 521 at the start of the second control. Such control prevents oil L in second oil separator 33 from being ejected, as in the first oil supply control. Such control also maintains the state in which oil L in first oil separator 23 is supplied to first and second compressors 211 and 212, and supplies oil L in first oil separator 23 to one of third compressor 311 and fourth compressor 312, that is, to the compressor in which the amount of oil L is less than the second threshold.

Based on the detection results of third and fourth oil amount detectors 311E and 312E, controller 62 determines whether or not the amount of oil L in each of all the compressors (third and fourth compressors 311 and 312) of second compression section 31 has reached or exceeded the second threshold (step S8). When controller 62 determines that the amount of oil L has not reached or exceeded the second threshold in all the compressors of second compression section 31 (step S8: NO), controller 62 performs the process of step S8 after a predetermined period of time. When controller 62 determines that the amount of oil L in each of all the compressors of second compression section 31 has reached or exceeded the second threshold (step S8: YES), controller 62 closes first oil supply valve 523 of first regulating mechanism 521 and also opens second ejection valve 54, thereby ending the second oil supply control (step S9), and starting first control. (Step S1). The processing of steps S1 to S9 described above is performed until the user issues a command to end the operation of refrigeration apparatus 1.

As described above, refrigeration apparatus 1 performs first control to circulate oil L in each of refrigeration units 2 and 3 when the amounts of oil L in first and second oil separators 23 and 33 are equal to or greater than a first threshold, that is, when the amount of oil L in each of all the compressors of first compression section 21 and second compression section 31 can be adjusted to be equal to or greater than a second threshold by supplying oil L circulating in each of refrigeration units 2 and 3. On the other hand, refrigeration apparatus 1 performs first oil supply control to supply oil L in the second refrigeration unit to first compression section 21 of first refrigeration unit 2, for example, when the amount of oil L in first oil separator 23 is less than the first threshold, that is, when the amounts of oil L in all the compressors of first compression section 21 cannot be increased to the second threshold or more by supplying oil L circulating in first refrigerating unit 2. As described above, refrigeration apparatus 1 can appropriately supply oil L separated by first and second oil separators 23 and 33 to first and second compression sections 21 and 31 according to the situation.

Variations of Embodiment

The present disclosure is not limited to the embodiments described above, and various modifications can be made without departing from the scope of the present disclosure. Moreover, the above embodiments and variations described below may be combined in any way as long as appropriate function can be obtained.

For example, it is possible not to provide first and second oil supply check valves 524 and 526 in first and second regulating mechanisms 521 and 522. Exemplary flow control mechanism 52 including first and second regulating mechanisms 521 and 522 is described above; however, oil supply pipe 51 may be configured from only one pipe, and the flow control mechanism may be configured from one electromagnetic valve or electric valve disposed in the pipe. When oil supply pipe 51 is configured from only one pipe, a flow control mechanism may be configured from a tube pump disposed in the pipe, and the direction in which oil L flows may be controlled to be switched by rotating a rotation body of a tube pump forward or backward. Exemplary first ejection valve 53 and second ejection valve 54 are described above as an ejection control mechanism; however, a tube pump may be applied.

An exemplary configuration in which controller 62 switches between the first control, the first oil supply control, and the second oil supply control based on the estimation results of oil amount estimator 61 is described above. However, the following configuration is also possible: a controller switches the oil return destination based on the first control from a user and operation from an operation section switching between the first oil supply control and the second oil supply control. The user may manually switch between first and second oil supply valves 523 and 525 and between first and second ejection valves 53 and 54, thereby switching the oil return destination without using a controller.

Oil amount estimator 61 may estimate whether or not the amount of oil L in each of oil separator 23 and 33 is less than the first threshold by disposing a detector in each of oil separator 23 and 33 for detecting the amount of oil L in each of oil separator 23 and 33, and estimating based on the detection results from the detectors.

Refrigeration apparatus 1 may include three or more refrigeration units disposed in parallel in a refrigeration cycle. In this case, the following is possible: providing a plurality of oil supply pipes connecting the oil return pipes of the respective refrigeration units to each other; disposing a flow control mechanism in each oil supply pipe; and disposing an ejection control mechanism in each oil return pipe.

INDUSTRIAL APPLICABILITY

The present disclosure is applicable to a refrigeration apparatus.

REFERENCE SIGNS LIST

1 Refrigeration apparatus
1A Refrigerator
1B Cooling unit
2 (First) refrigeration unit
3 (Second) refrigeration unit
4 Subcooling mechanism
5 Oil return control mechanism
6 Control device
21, 31 First and second compression sections
22, 32 First and second heat dissipation heat exchangers
23, 33 First and second oil separators
41 First pressure reducing valve
42 Intermediate cooler
43 Split heat exchanger
44 Second pressure reducing valve
45 Evaporator
51 Oil supply pipe
52 Flow control mechanism
53, 54 First and second ejection valves
61 Oil amount estimator
62 Controller
211, 212, 311, 312 First, second, third, and fourth compressors
211A, 212A, 311A, 312A First, second, third, and fourth low-stage suction ports
211B, 212B, 311B, 312B First, second, third, and fourth low-stage discharge ports
211C, 212C, 311C, 312C First, second, third, and fourth high-stage suction ports
211D, 212D, 311D, 312D First, second, third, and fourth high-stage discharge ports
211E, 212E, 311E, 312E First, second, third, and fourth oil amount detectors
221, 321 First and second heat dissipation fans
222, 322 First and second intercoolers
223, 323 First and second gas coolers
224, 324 First and second outside air temperature sensors
431, 432 First and second flow channels
511, 512 First and second oil supply base pipes
513, 514 First and second oil supply branch pipes
521, 522 First and second regulating mechanisms
523, 525 First and second oil supply valves
524, 526 First and second oil supply check valves
CV1, CV2, CV3, CV11, CV12, CV13 Check valve
H High pressure sensor
P1, P2, P3, P4, P5, P6, P7, P8, P9, P10, P21, P22, P23, P24, P25, P26, P27, P28, P29, P30,
P31, P41, P42, P43, P44, P45, Q1, Q2 Pipe
Q10, Q20 First and second base pipes
Q11, Q12, Q21, Q22 First, second, third, and fourth branch pipes
V1, V2, V3, V4 First, second, third, and fourth oil valves
V11 Gas return electric valve
V12 Liquid return electric valve

The invention claimed is:

1. A refrigeration apparatus, comprising:

a plurality of refrigeration units each including a compressor, an oil separator, an oil return pipe that returns oil separated from a refrigerant by the oil separator to the compressor, and a heat dissipation heat exchanger that cools the refrigerant from which the oil has been separated;

a pressure reducing valve connected to the heat dissipation heat exchangers of the plurality of refrigeration units; and an oil return control mechanism that controls a return destination of the oil separated by at least one of the oil separators of the plurality of refrigeration units, wherein the oil return control mechanism includes:

an oil supply pipe that connects the oil return pipes of the plurality of refrigeration units to each other, a flow control mechanism disposed in the oil supply pipe, the flow control mechanism controlling a flowing condition of oil in the oil supply pipe, and ejection control mechanisms each disposed in a corresponding one of the oil return pipes at a position closer to a corresponding one of the oil separators than a connection position is, each of the ejection control mechanisms controlling an ejection condition of oil ejected from the corresponding oil separator, the connection position being a position where the corresponding oil return pipe connects to the oil supply pipe, wherein oil valves, each being configured to control an amount of the oil returned from the oil separator to the compressor by adjusting an opening degree, are provided in the respective oil return pipes.

2. The refrigeration apparatus according to claim 1, wherein:

the flow control mechanism includes a plurality of regulating mechanisms disposed in the oil supply pipe;

each of the plurality of regulating mechanisms includes an oil supply valve and an oil supply check valve disposed in series; and the oil supply check valve is disposed so as to allow oil to flow only in one direction.

3. The refrigeration apparatus according to claim 2, further comprising:

a controller that controls the oil return control mechanism, wherein each of the ejection control mechanisms includes an ejection valve, and the controller performs:

first control to circulate oil in each of the refrigeration units by closing all the oil supply valves and opening all the ejection valves, and second control to supply, into the compressor of a predetermined refrigeration unit among the plurality of refrigeration units, oil in other refrigeration unit among the plurality of refrigeration units by closing the ejection valve disposed in the oil return pipe of the predetermined refrigeration unit, and by opening the oil supply valve of a regulating mechanism that allows oil to flow to the predetermined refrigeration unit, the regulating mechanism being one of the plurality of regulating mechanisms in the oil supply pipe connected to the oil return pipe of the predetermined refrigeration unit.

4. The refrigeration apparatus according to claim 3, further comprising:

an oil amount estimator that estimates an oil amount in each of the oil separators, wherein the controller performs:

the first control when the oil amount estimator estimates that the oil amount in each of the oil separators of all the refrigeration units is equal to or greater than a threshold, and the second control when the oil amount estimator estimates that the oil amount in the oil separator of the other refrigeration unit is less than the threshold.

5. The refrigeration apparatus according to claim 4, wherein:

in the compressors, oil amount detectors each detecting an oil amount in a corresponding one of the compressors are respectively disposed, and the oil amount estimator determines whether or not the oil amount in each of the oil separators is less than the threshold based on a detection result of at least one of the oil amount detectors.

6. The refrigeration apparatus according to claim 1, further comprising:

a controller that controls the oil return control mechanism; and an oil amount estimator that estimates an oil amount in each of the oil separators, wherein each of the ejection control mechanisms includes an ejection valve, and in a case that the oil amount estimator estimates that the oil amount in each of the oil separators of all the refrigeration units is equal to or greater than a threshold, the controller is configured to perform to close the ejection valve provided on the oil return pipe of the refrigeration unit where the oil amount is estimated to be below the threshold.

7. A refrigeration apparatus, comprising:

a plurality of refrigeration units each including a compressor, an oil separator, an oil return pipe that returns oil separated from a refrigerant by the oil separator to the compressor, and a heat dissipation heat exchanger that cools the refrigerant from which the oil has been separated;

a pressure reducing valve connected to the heat dissipation heat exchangers of the plurality of refrigeration units; and an oil return control mechanism that controls a return destination of the oil separated by at least one of the oil separators of the plurality of refrigeration units, wherein the oil return control mechanism includes:

an oil supply pipe that connects the oil return pipes of the plurality of refrigeration units to each other, a flow control mechanism disposed in the oil supply pipe, the flow control mechanism controlling a flowing condition of oil in the oil supply pipe, and ejection control mechanisms each disposed in a corresponding one of the oil return pipes at a position closer to a corresponding one of the oil separators than a connection position is, each of the ejection control mechanisms controlling an ejection condition of oil ejected from the corresponding oil separator, the connection position being a position where the corresponding oil return pipe connects to the oil supply pipe, wherein:

the flow control mechanism includes a plurality of regulating mechanisms disposed in the oil supply pipe;

each of the plurality of regulating mechanisms includes an oil supply valve and an oil supply check valve disposed in series; and the oil supply check valve is disposed so as to allow oil to flow only in one direction.

8. A refrigeration apparatus, comprising:

a plurality of refrigeration units each including a compressor, an oil separator, an oil return pipe that returns oil separated from a refrigerant by the oil separator to the compressor, and a heat dissipation heat exchanger that cools the refrigerant from which the oil has been separated;

a pressure reducing valve connected to the heat dissipation heat exchangers of the plurality of refrigeration units; and an oil return control mechanism that controls a return destination of the oil separated by at least one of the oil separators of the plurality of refrigeration units, wherein the oil return control mechanism includes:

an oil supply pipe that connects the oil return pipes of the plurality of refrigeration units to each other, a flow control mechanism disposed in the oil supply pipe, the flow control mechanism controlling a flowing condition of oil in the oil supply pipe, and ejection control mechanisms each disposed in a corresponding one of the oil return pipes at a position closer to a corresponding one of the oil separators than a connection position is, each of the ejection control mechanisms controlling an ejection condition of oil ejected from the corresponding oil separator, the connection position being a position where the corresponding oil return pipe connects to the oil supply pipe, the refrigeration apparatus further comprises:

a controller that controls the oil return control mechanism, wherein each of the ejection control mechanisms includes an ejection valve, and the controller performs:

first control to circulate oil in each of the refrigeration units by closing all the oil supply valves and opening all the ejection valves, and second control to supply, into the compressor of a predetermined refrigeration unit among the plurality of refrigeration units, oil in other refrigeration unit among the plurality of refrigeration units by closing the ejection valve disposed in the oil return pipe of the predetermined refrigeration unit, and by opening the oil supply valve of a regulating mechanism that allows oil to flow to the predetermined refrigeration unit, the regulating mechanism being one of the plurality of regulating mechanisms in the oil supply pipe connected to the oil return pipe of the predetermined refrigeration unit.

* * * * *